US010094222B2

(12) United States Patent
Koivikko et al.

(10) Patent No.: US 10,094,222 B2
(45) Date of Patent: Oct. 9, 2018

(54) IMPELLER FOR A CENTRIFUGAL PUMP

(71) Applicant: Sulzer Pumpen AG, Winterthur (CH)

(72) Inventors: Matti Koivikko, Kotka (FI); Kalle Tiitinen, Inkeroinen (FI); Sami Virtanen, Kotka (FI); Jussi Matula, Savonlinna (FI)

(73) Assignee: Sulzer Management AG, Winterthur (CH)

( * ) Notice: Subject to any disclaimer, the term of this patent is extended or adjusted under 35 U.S.C. 154(b) by 1188 days.

(21) Appl. No.: 14/032,148

(22) Filed: Sep. 19, 2013

(65) Prior Publication Data

US 2014/0079558 A1 Mar. 20, 2014

(30) Foreign Application Priority Data

Sep. 20, 2012 (EP) ..... 12185301

(51) Int. Cl.

| | |
|---|---|
| ***F04D 29/22*** | (2006.01) |
| ***F01D 5/14*** | (2006.01) |
| *F04D 7/04* | (2006.01) |
| *F04D 29/24* | (2006.01) |

(52) U.S. Cl.

CPC ..... *F01D 5/141* (2013.01); *F04D 29/24* (2013.01); *F04D 29/242* (2013.01); *F01D 5/145* (2013.01);

(Continued)

(58) Field of Classification Search

CPC ..... F04D 29/2261; F04D 29/2272; F04D 29/2288; F04D 29/24; F04D 29/242;

(Continued)

(56) References Cited

U.S. PATENT DOCUMENTS 1,959,710 A * 5/1934 Durdin, Jr. ..... F04D 29/225 415/106

2,266,180 A 12/1941 Emerick (Continued)

FOREIGN PATENT DOCUMENTS

CH 378165 A 5/1964
CN 201292984 Y 8/2009

(Continued)

OTHER PUBLICATIONS

Extended European Search Report dated Mar. 18, 2013 in Application No. 12185301.4.

*Primary Examiner* — Jason Shanske
*Assistant Examiner* — Behnoush Haghighian
(74) *Attorney, Agent, or Firm* — Kilpatrick Townsend & Stockton LLP

(57) ABSTRACT

The present invention relates to a centrifugal pump, the impeller of which comprises a shroud (34) with at least one solid and rigid working vane (36), and at least one solid and rigid rear vane (38), the at least one working vane (36) having a leading edge region (46), a trailing edge region (48), a central region (C), a side edge, a pressure face (42) and a suction face (44), the at least one solid and rigid rear vane (38) having a trailing edge region, a side edge, a pressure face and a suction face. The trailing edge region (48) of the at least one working vane (36) is rounded by means of a rounding to have a thickness greater than that in the central region (C).

14 Claims, 3 Drawing Sheets

(52) U.S. Cl.
CPC ..... *F01D 5/147* (2013.01); *F04D 7/04* (2013.01); *F04D 7/045* (2013.01); *F04D 29/2261* (2013.01); *F04D 29/2272* (2013.01); *F04D 29/2288* (2013.01); *F04D 29/245* (2013.01)

(58) Field of Classification Search
CPC ..... F04D 29/245; F04D 7/04; F04D 7/045; F04D 29/2216; F04D 29/2227; F04D 29/2294; F01D 5/141; F01D 5/145; F01D 5/147
See application file for complete search history.

(56) References Cited

U.S. PATENT DOCUMENTS

| | | | | | |
|---|---|---|---|---|---|
| 2,404,678 | A | | 7/1946 | Wuensch | |
| 4,792,275 | A | * | 12/1988 | Weinrib | F04D 7/04 415/120 |
| 5,064,346 | A | * | 11/1991 | Atarashi | F01D 5/141 416/178 |
| 5,102,297 | A | * | 4/1992 | Thompson | F04D 9/005 415/206 |
| 9,388,822 | B2 | * | 7/2016 | Roth | F04D 29/448 |

FOREIGN PATENT DOCUMENTS

| | | | | | |
|---|---|---|---|---|---|
| CN | 102011749 | A | | 4/2011 | |
| EP | 06407868 | A1 | | 3/1995 | |
| EP | 0684386 | A1 | | 11/1995 | |
| FR | 1274289 | A | | 10/1961 | |
| GB | 365817 | A | | 1/1932 | |
| GB | 1412488 | A | * | 11/1975 | F04D 7/04 |
| WO | 92/18773 | A1 | | 10/1992 | |

* cited by examiner

IMPELLER FOR A CENTRIFUGAL PUMP

This application claims priority to European Application No. 12185301.4 filed on Sep. 20, 2012, the disclosure of which is incorporated by reference herein.

TECHNICAL FIELD

The present invention relates to an impeller for a centrifugal pump. The impeller of the present invention is applicable when pumping fibrous suspension. The impeller of the present invention is especially applicable in pumping fibrous suspensions, like paper making stock, to the head box of a paper or board machine.

BACKGROUND ART

Centrifugal pumps are used for pumping a wide variety of liquids and suspensions. The pumps used for pumping clean liquids differ a great deal from the pumps used for pumping suspensions or even substantially large sized solid particles like fish, for instance. When pumping liquids it is the head and the efficiency ratio that normally count. But when pumping suspensions or solids in liquid, the properties of the solids start playing an important role. The larger the solid particles are the bigger is their role in the design of the pump. In some applications, the solid particles to be pumped should be handled with care, i.e. such that the pumping does not break the particles. In some other applications the purpose may be the opposite. For instance in pumping sewage slurries the pumps are often provided with some kind of breaking means for chopping the solids into smaller particles. And sometimes the fluid to be pumped contains solid particles that tend to block the pump. In such a case the fluid to be pumped contains long filaments, threads, strings or other lengthy flexible objects that easily adhere to the leading edge of the impeller vanes and start collecting other objects so that a thicker rope-like object is formed. Such an object not only grows larger and larger blocking gradually the vane channels, but also easily gets into the gaps between the impeller vanes and the pump housing increasing the power needed to rotate the impeller, and causing mechanical stress to both the shaft of the pump, the coupling between the pump and the drive motor, and the impeller vanes.

A yet further type of fluids pumped by means of a centrifugal pump is fibrous suspensions of pulp and paper industry. In such a case the fibers or particles of the suspension are relatively small, i.e. the length of the fibers being of the order of a fraction of a millimeter to about 10 millimeters. Such fibrous suspensions are not normally able to block the pump, but it has been, however, learned that the fibers tend to adhere to the leading edge of an impeller vane of an ordinary centrifugal pump. Here, an ordinary centrifugal pump is supposed to have vanes of a traditional water pump, in other words vanes, whose leading edges are sharpened, i.e. thinner than the rest of the vane thickness. The problem of fibers adhering to the leading edges of the vanes has been discussed in GB-A-1412488. The problem has been solved by thickening the leading edge of the vane such that the diameter of the thickened leading edge is larger than the thickness of the rest of the vane. This structural feature together with the increased turbulence achieved by a change in the inlet angle of the impeller vane prevents fibers from adhering to the leading edge of the vane.

On the one hand, the above discussed GB-document does not teach the actual problem related to the fibers adhering to the leading edge of the vanes, and, on the other hand, does not even recognize that a similar problem appears at the trailing edges of the vanes as well. Thus, what makes the adhering of the fibers to the leading and trailing edges of the vanes so significant is that the fibers when adhering to the edges result in flocs, threads or strings of several fibers being released from the edge from time to time and being pumped by the pump further in the process. When the process is, for instance, a paper or board making process of pulp and paper industry the flocs, threads or strings enter the web forming stage and remain visible in the end product or they may as well cause a hole in the end product or, as the worst option, a web breakage.

Another problem that was observed when studying impellers used for pumping fibrous suspensions relates to yet other edge areas of the impeller. In other words, it was observed that while the cross section of both working and rear vanes of ordinary centrifugal pumps is, in practice, rectangular, the vanes have at their free ends two relatively sharp edges (applies to semi-open impellers). In a similar manner also the leading and trailing edges of the shroud/s may have sharp edges. Also the center wall of a double-suction impeller normally has sharp edges at its outer circumference. It was learned in the performed experiments that the sharp edges tend to collect fibers. The fibers adhered to the edge/s allow new fibers to adhere, too, either to the sides of the earlier fibers or to the earlier fibers itself. The turbulence caused by the movement of the vanes in the nearhood of the stationary volute/casing creates turbulence that easily starts winding the fibers together whereafter a thread is formed. When such thread/s are released from the edge/s in head box feed pumps of, for instance, a paper or board making process of pulp and paper industry the threads enter the web forming stage and remain visible in the end product or they may as well cause a hole in the end product or, as the worst option, a web breakage.

BRIEF SUMMARY OF THE INVENTION

Thus an object of the present invention is to develop a new type of an impeller for a centrifugal pump capable of avoiding at least one of the above discussed problems.

Another object of the invention is to develop such a novel impeller for a centrifugal pump that does not allow fibers to adhere to the leading and trailing edges of its vanes.

A further object of the invention is to develop such a novel impeller for a centrifugal pump that does not allow fibers to adhere to the other edges of its vanes, shrouds or discs.

At least one of the objects of the present invention is fulfilled by an impeller for a centrifugal pump, the impeller comprising a hub with at least one solid and rigid working vane, the at least one solid and rigid working vane having a leading edge region, a trailing edge region, a central region, a side edge, a pressure face and a suction face, the leading edge region of the at least one solid and rigid working vane being provided with a rounding or thickened part having a thickness greater than that in the central region, wherein the trailing edge region of the at least one solid and rigid working vane is rounded by means of a rounding to have a thickness greater than that in the central region.

Other characterizing features of the impeller of the present invention become evident in the accompanying dependent claims.

BRIEF DESCRIPTION OF DRAWING

The impeller for a centrifugal pump is described more in detail below, with reference to the accompanying drawings, in which.

DETAILED DESCRIPTION OF DRAWINGS

Figure 1:
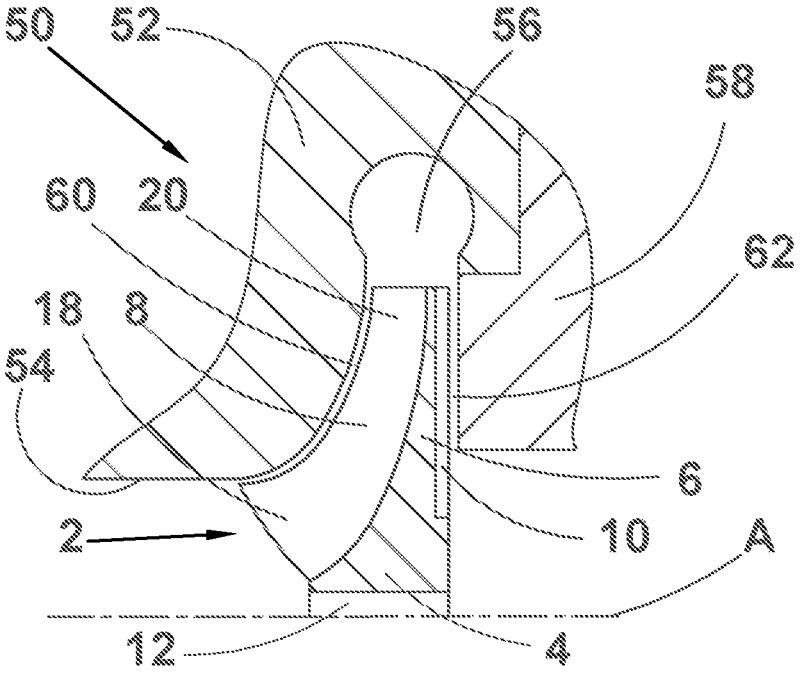
Fig. 1 (Prior Art)
FIG. 1 illustrates schematically a partial cross section of a centrifugal pump.

FIG. 1 is a general illustration of a centrifugal pump as a partial cross section. The centrifugal pump 50 comprises an impeller 2 fastened on a shaft (not shown) for rotation about axis A within a volute 52 having an inlet 54 and an outlet arranged tangentially to the spiral 56. The volute 52 is fastened to the pump casing 58 housing the sealings and bearings (not shown) of the pump 50. The impeller 2 has a hub 4 and, in a semi-open impeller, a disc shaped shroud 6, also called as back plate, extending outwardly from the hub 4. At least one solid and rigid pumping vane or working vane 8 is arranged to extend outwardly from the hub 4. In a semi-open impeller the solid and rigid working vane/s is/are arranged on the front side of the shroud 6, i.e. the side facing the incoming fluid in the inlet 52. If needed, one or more solid and rigid rear vanes 10 have been arranged on the rear face of the shroud 6 extending outwardly from the hub 4. The hub 4 is also provided with a central opening 12 for the shaft of the centrifugal pump. The working vanes 8 of the impeller have a leading edge region 18 and a trailing edge region 20. The working vanes are arranged within the volute 52 such that a front clearance 60 is left between the working vanes 8 and the volute 52. However, if it is a question of a closed impeller, i.e. an impeller having shrouds, sometimes called as front and back plates, on both sides of the working vanes, the front clearance may be found between the front shroud and the volute. A corresponding rear clearance 62 is left between the rear vanes 10 and the casing 58 of the pump 50. If there are no rear vanes the clearance may be found between the shroud 6 and the casing. And if there is no shroud either, the rear clearance is between the working vanes and the casing 58.

Figure 2:
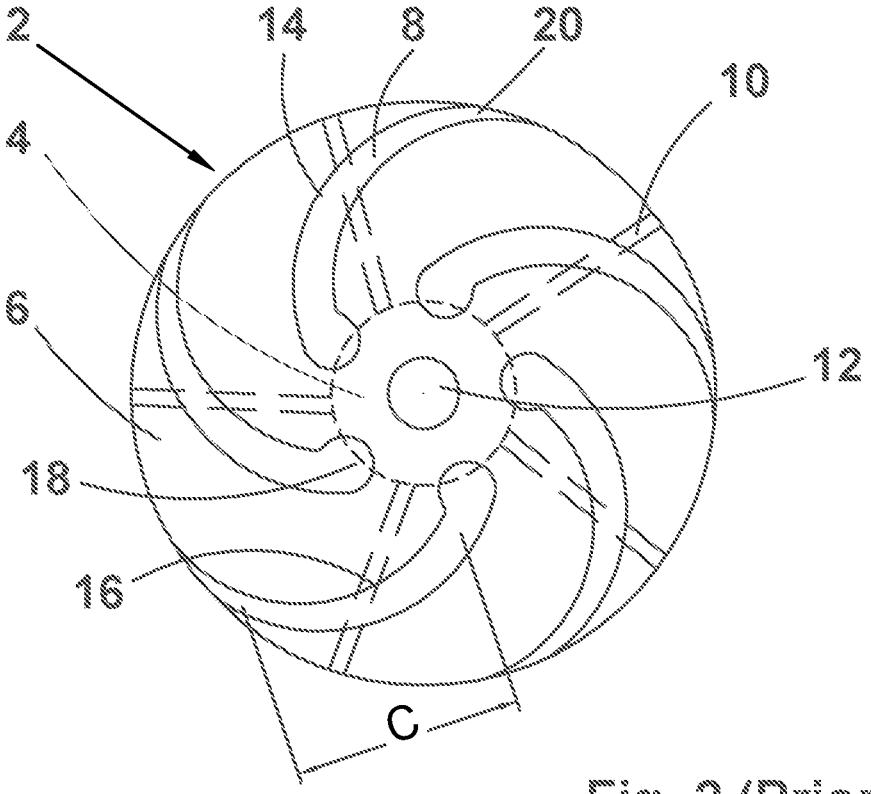
Fig. 2 (Prior Art)
FIG. 2 illustrates schematically a prior art impeller of a centrifugal pump as seen from the direction of an incoming fluid.

FIG. 2 illustrates schematically an impeller of a prior art centrifugal pump seen from the direction the fluid enters the pump. The impeller 2 is formed of a hub 4 and a disc shaped shroud 6, solid and rigid pumping vanes or working vanes 8 on the front side of the shroud 6, i.e. the side facing the incoming fluid, and solid and rigid rear vanes 10 (shown with broken lines) on the rear face of the shroud 6. The working vanes 8 may extend radially outwardly to the circumference of the shroud 6, but may as well extend radially outside the shroud 6 or remain radially inside the circumference of the shroud 6. The rear vanes 10 normally extend to the outer circumference of the shroud 6, but may also remain short thereof. The hub 4 is also provided with a central opening 12 for fastening the impeller 2 on the shaft of a centrifugal pump. Each working vane 8 has two faces or sides. The leading side surface or face 14 is called the pressure face, as it functions by pushing the fluid in the direction of the rotation of the impeller as well as radially outwardly, whereby the pressure at the vane surface 14 is increased. The opposite side is called a suction face surface or face 16, as the pressure at the vane surface 16 is decreased. The impeller 2 working vanes 8 have a leading edge region 18 and a trailing edge region 20, and a central region C therebetween. The vane at the leading edge region 18 of the prior art working vanes 8 is rounded and has a thickness greater than that of the remaining part of the vane 8 or that of the central region C. The vane at the trailing edge region 20 of the working vanes 8 is normally sharpened, i.e. its thickness is smaller than the thickness of the rest of the working vane 8 or that of the central region C. The working vanes 8 may have, also at its central region C, a constantly diminishing thickness from the leading edge region 18 to the trailing edge region 20 as shown in FIG. 1, or the thickness of the vane may be constant at the central region C between the two edge regions.

Figure 3:
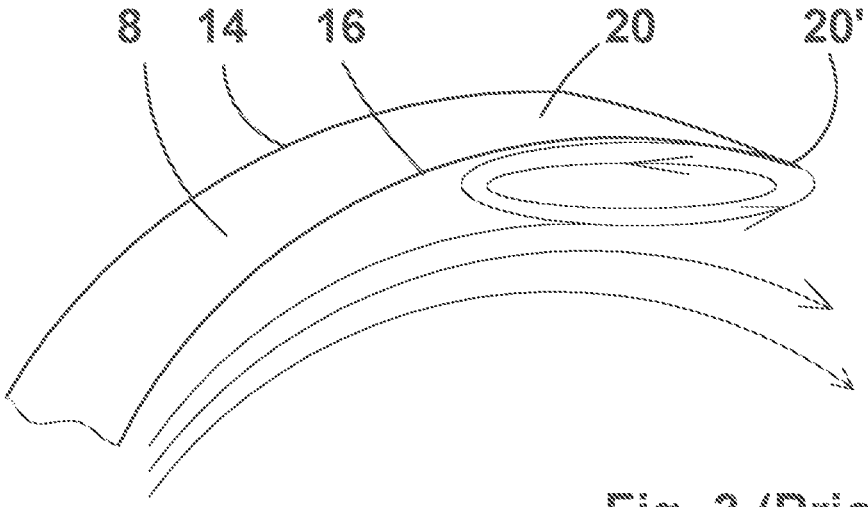
Fig. 3 (Prior Art)
FIG. 3 illustrates schematically a trailing section of a vane of an impeller of FIG. 2 discussing the problem relating to the trailing edge of the vane.

FIG. 3 illustrates a trailing section of a working vane 8 of an impeller of FIG. 2 discussing schematically the problem relating to the trailing edge region 20 of the working vane 8. The curved arrows shown below the suction face 16 of the working vane show the direction of the fluid flow between two working vanes. It has been observed that the fluid flow separates from the suction face surface 16 of the working vane 8 at the trailing edge region 20 to the extent that the flow turns to the opposite direction and starts flowing radially inwardly along the suction face surface 16 of the working vane 8. Thus a recirculating flow is created. Naturally, the cause for the inward flow is the reduced pressure at the suction face surface 16 of the working vane 8.

This phenomenon is not a problem worth significant consideration when clean liquid is pumped, but, when the liquid carries for instance fibers, the problem gets serious. The fibers moving along with the recirculating flow are easily caught by the sharp trailing edge 20' of the working vane 8. Gradually a fiber floc or string or thread is created by fibers adhering to both the edge 20' and each other. From time to time the flocs or threads are loosened from the edge 20' by the fluid flow along the pressure face surface 14 and are thereafter pumped further in the process. In case the pump is a headbox feed pump of a paper or board machine the released flocs and threads flow along with the paper or board making stock to the headbox and further on the web forming section of the paper or board machine. When entering the web the flocs or threads reduce the quality of the end product, by being visible in the end product or causing holes in the web or web breakage as the worst alternative.

Figure 4:
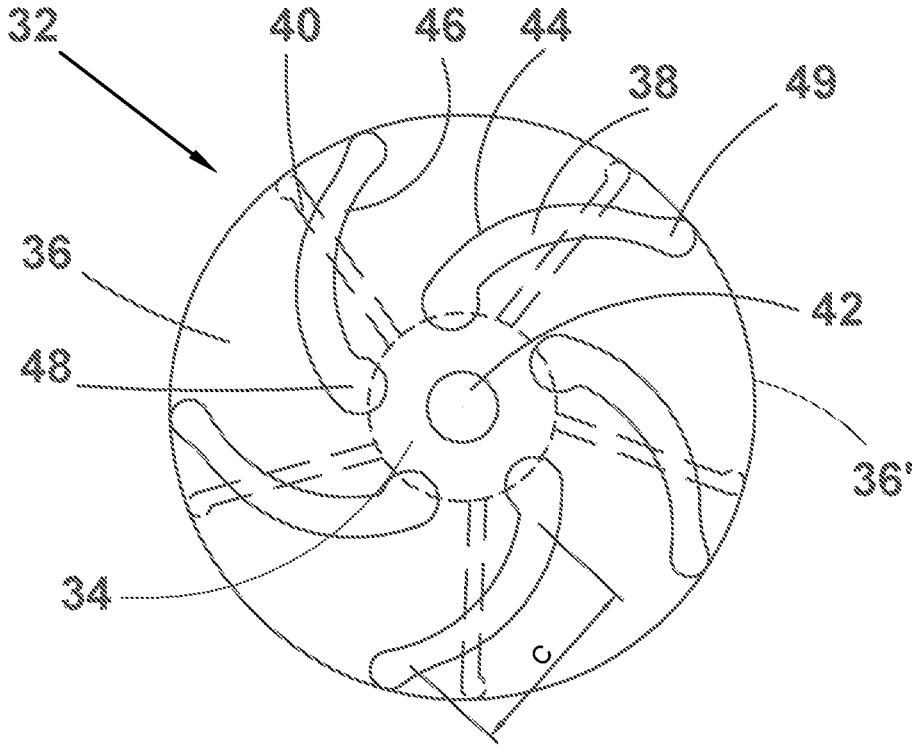
FIG. 4 illustrates schematically an impeller in accordance with a preferred embodiment of the present invention as seen from the direction of an incoming fluid.

FIG. 4 illustrates schematically an impeller 32 in accordance with a preferred embodiment of the present invention solving the above described problem. The impeller 32 is formed of a hub 34 with a disc shaped shroud 36 with a rounded trailing edge 36', solid and rigid pumping vanes or working vanes 38 on the front side of the shroud 36, i.e. the side facing the incoming fluid, and solid and rigid rear vanes 40 (shown with broken lines) on the rear face of the shroud 36. The solid and rigid working vanes 38 may extend radially outwardly to the circumference of the shroud 36, but may as well extend radially outside the shroud 36 or remain radially inside the circumference of the shroud 36. The shroud 36 is also provided with a central opening 42 for fastening the impeller on the shaft of a centrifugal pump. Each solid and rigid working vane 38 has two faces or sides. The leading side or face 44 is called the pressure face, as it functions by pushing the fluid in the direction of the rotation of the impeller as well as radially outwardly, whereby the pressure at the vane surface is increased. The opposite side is called a suction face surface or face 46, as the pressure at the vane surface is decreased. The working vanes of the impeller have a leading edge region 48 and a trailing edge region 49. At the leading edge region 48 each working vane 38 is provided with a rounding or thickened part that is preferably, but not necessarily, located to the side of the suction face 46 of the vane 38. In other words the pressure face or face 44 of each vane is streamlined from its leading edge onwards. The cross section of the rounding or the thickened part is preferably, but not necessarily, for a considerable part thereof circular.

In other words the pressure face or face 44 of each vane is streamlined from its leading edge onwards. The cross section of the rounding or the thickened part is preferably, but not necessarily, for a considerable part thereof circular.

The impeller 32 of the present invention differs from the prior art impeller of FIG. 1 in that the trailing edge region 49 of each solid and rigid working vane 38 is rounded and has a thickness greater than the central region C of the vane 38, i.e. the region of the working vane between the leading edge region 48 and the trailing edge region 49. The rounding at the trailing edge region 49 of each working vane 38 is preferably, but not necessarily, arranged on the pressure face 44 of the vane 38. The rounding is preferably, but not necessarily, mostly circular of its cross section. In fact, by the word rounding all such shapes are understood that prevent the fibres from adhering to the edge in question. Thus, preferably but not necessarily, the thickened part of the vane joins to the central part of the vane smoothly, i.e. in a streamlined fashion to prevent flow losses. One way to define the diameter of the rounding or the thickness of the working vane 38 at the trailing edge region 49 is to find a balance between the hydraulic efficiency of the impeller and the capability of preventing fibres from adhering to the edges of the vanes. Performed experiments have shown that the diameter of the rounding is preferably at least of the order of 1,1* the thickness of the working vane at the central region, more preferably at least 1,3* the thickness of the working vane depending on the length/size distribution of the fibres or particles. The rounding prevents the fibers meeting the rounded trailing edge from forming a sharp bend round the trailing edge that would facilitate their adherence to the leading edge. Now that the trailing edge is rounded any fiber laying against the surface of the trailing edge is easily wiped out of the surface by the slightest turbulence near the trailing edge region.

As an additional feature, which may be used, but is not necessarily used, together with the above discussed invention relating to rounding the trailing edges of the working vanes, FIG. 4 also shows how the solid and rigid rear vanes 40 have been rounded at their trailing edges. The rounding at the trailing edge region of each rear vane 40 is preferably, but not necessarily, arranged on the pressure face of the rear vane 40. The rounding is preferably, but not necessarily, mostly circular of its cross section. In fact, by the word rounding all such shapes are understood that prevent the fibers from adhering to the edge in question. Thus, preferably but not necessarily, the thickened part of the vane joins to the central part of the vane smoothly, i.e. in a streamlined fashion to prevent flow losses. Performed experiments have shown that the diameter (or a corresponding measure indicating the thickness of the vane at its thickest point) of the rounding is preferably at least of the order of 1,1*the thickness of the rear vane at the central region, more preferably at least 1,3*the thickness of the rear vane depending on the length/size distribution of the fibres or particles. The rounding prevents the fibers meeting the rounded trailing edge from forming a sharp bend round the trailing edge that would facilitate their adherence to the leading edge. Now that the trailing edge is rounded any fiber laying against the surface of the trailing edge is easily wiped out of the surface by the slightest turbulence near the trailing edge region.

Figure 5:
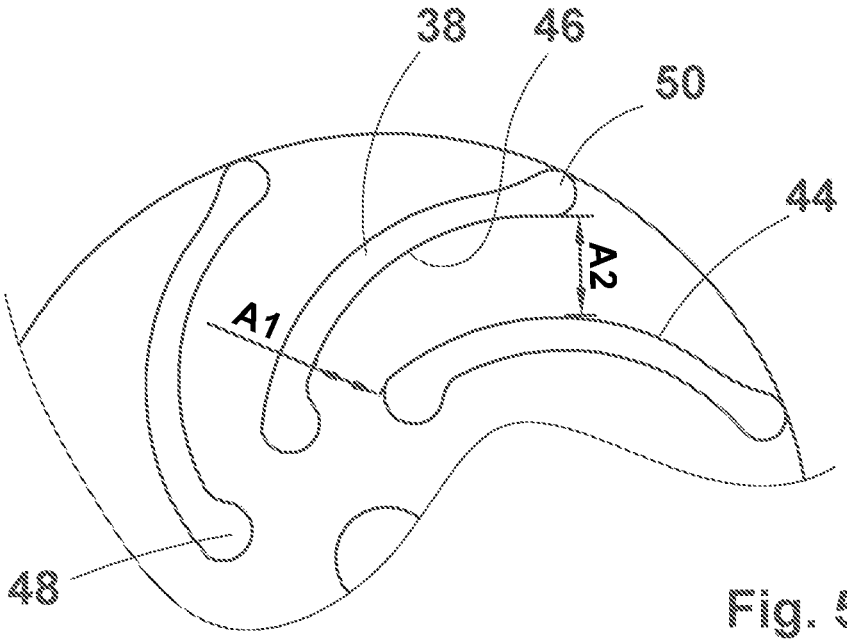
FIG. 5 illustrates a partial cross section of an impeller in accordance with a preferred embodiment of the present invention.

FIG. 5 illustrates a partial cross section of an impeller in accordance with a preferred embodiment of the present invention. The Figure shows how the thickened leading and trailing edges of the solid and rigid working vanes 38 do not throttle the flow area between adjacent vanes. For instance, if the rounding at the leading edge were on the pressure face 44 of the working vane 38, the smallest flow area A1 would be located between the rounding and the suction face 46 of the preceding working vane 38. Thereby the flow area would be significantly smaller as now that the rounding 48 is on the suction face 46. In a similar manner if the rounding at the trailing edge were positioned on the suction face 46 of the vane 38, the smallest flow area A2 would be located between the rounding and the pressure face 44 of the following working vane 38. Thereby the flow area would be significantly smaller as now that the rounding is on the pressure face 44. Thus, positioning the rounding 48 on a certain face of the working vane 38 brings a further advantage, or, in fact, avoids a disadvantage.

Figure 6:
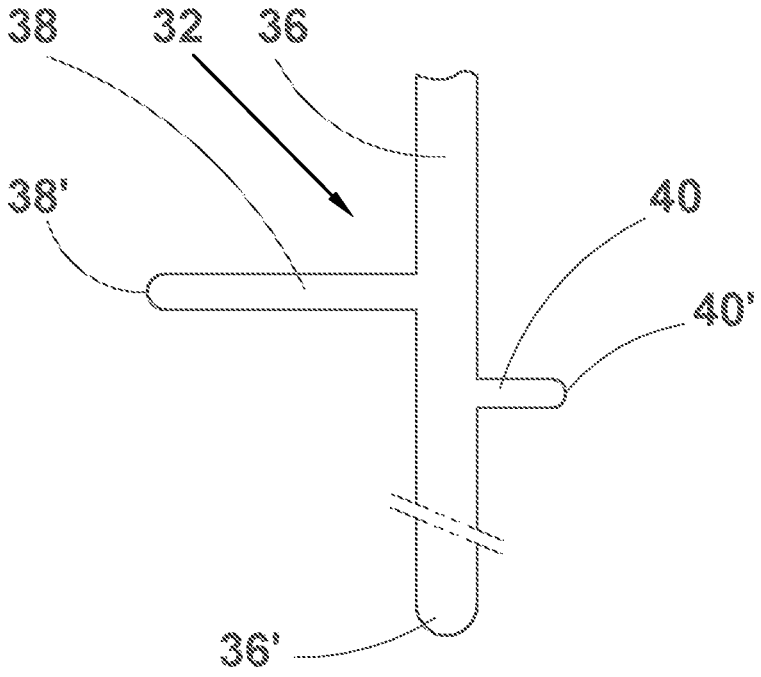
FIG. 6 illustrates schematically a partial cross section of an impeller as seen from the direction towards the axis of the impeller.

FIG. 6 illustrates a partial section of the impeller 32 of the invention seen from the side of the impeller towards the axis thereof. In other words, the Figure shows the outer edges of the shroud 36, the solid and rigid working vane 38 and the solid and rigid rear vane 40 in accordance with a further preferred embodiment of the present invention. The background for studying the shapes of the vanes is the fact that, in the same manner as with the leading and trailing edges, the fibers moving along with the fluid to be pumped tend to adhere also to such sharp edges of the vanes that extend in the direction of the fluid flow. In prior art centrifugal pumps having semi-open impellers the side edges (the edges in the direction of flow are from now on called side edges) of the vanes have been, in practice, rectangular. Now that fibers have adhered to such an edge, the flow brings new fibers that adhere to the side of the first fibers or to the fibers itself. Due to the closeness of the volute wall the flow is turbulent with some clear circulation, whereby the fibers adhered to the edge or to each other easily start winding and forming a lengthy thread that from time to time loosens and is pumped further to the process. In case the pump is a headbox feed pump of a paper or board machine the loosened threads flow along with the paper or board making stock to the headbox and further on the web forming section of the paper or board machine. When entering the web the flocs or threads reduce the quality of the end product, by being visible in the end product or causing holes in the web or web breakage as the worst alternative.

A first cure for the above defined problem is in principle the same as already discussed in connection with FIG. 4, i.e. rounding of the edge of the vane. In other words, the edge 38' of each working vane 38 facing the volute is rounded such that the adherence of the fibers to the edge is hampered significantly. In a similar manner also the edge 40' of each back vane 40 facing the pump casing is rounded for the same purpose. The rounding at the edges may be such that the thickness of the vane is not increased at the rounding, but it is, naturally, also possible to increase the thickness by the rounding as discussed in connection with the embodiment of FIG. 4. Performed experiments have shown that the both free edges (in fact, if a vane having a rectangular cross section is viewed in more detail it appears that the free edge (not the one possibly attached to a shroud) of the vane actually has two edges) of the vanes should be rounded to have a radius of at least one quarter of the thickness of the working vanes or rear vanes.

Another cure for the above defined problem is to increase at least one of the front and the rear clearance, as the larger the clearance is, the weaker is the turbulence tending to wind the adhered fibers to a thread, and the easier the possible adhered fibers are loosened, and the more difficult a fiber is to adhere to the edge. In other words, as the clearance in ordinary centrifugal pumps used for pumping fibrous suspensions has been of the order of 1 millimeter, the clearance/s has/have been increased to at least 2 millimeter, possibly up to 4 millimeter. In more general terms, it has been considered that the clearance should be more than in conventional pumps designed for clean water.

In view of the above it should be understood that the above description discusses and the Figures show a single suction semi-open impeller, i.e. an impeller having a suction eye or fluid inlet in one axial direction and a shroud on one side of the working vanes, as an example of all possible variations of a centrifugal pump impeller. However, the invention may be applied to all kinds of centrifugal impellers. In other words, the impeller may also be a double-suction impeller, i.e. an impeller having a suction eye or fluid inlet on both opposite axial sides of the impeller. The impeller may also be a closed one (shrouds on both sides of the working vanes) or an open one (no shroud at all). And further, the double suction impeller may be provided with a hub disc, i.e. a wall at the radial centerline plane of the impeller, and shroud discs, normally called shrouds, arranged at the outer edges of the working vanes. Performed experiments have shown that the both free edges (in fact, if any shroud or disc having a rectangular shape at its free edge is viewed in more detail it appears that the free edge actually has two edges) of the shrouds or discs should be rounded to have a radius of at least one quarter of the thickness of the working vanes or rear vanes.

Thus it is clear that the impeller may have several other elements, like shroud/s, disk/s etc, which have leading and trailing edges to which fibrous material may adhere. Therefore the above discussed principles of rounding the above mentioned leading and trailing edges apply to all these edges, too.

As can be seen from the above description a novel impeller construction has been developed. While the invention has been herein described by way of examples in connection with what are at present considered to be the preferred embodiments, it is to be understood that the invention is not limited to the disclosed embodiments, but is intended to cover various combinations and/or modifications of its features and other applications within the scope of the invention as defined in the appended claims.

The invention claimed is:

1. An impeller for a centrifugal pump, the impeller comprising a hub with at least one solid and rigid working vane, the at least one solid and rigid working vane having a leading edge region, a trailing edge region, a central region, a thickness at the central region, a side edge, a pressure face, and a suction face, the leading edge region of the at least one solid and rigid working vane being provided with a first rounding having a thickness greater than that in the central region, wherein the trailing edge region of the at least one solid and rigid working vane is provided with a second rounding to have a thickness greater than that in the central region, and wherein the second rounding at the trailing edge region is arranged on the pressure face of the working vane.

2. The impeller as recited in claim 1, wherein the second rounding has a circular cross section.

3. The impeller as recited in claim 2, wherein the second rounding has a diameter of at least 1.1 times the thickness of the working vane at its central region.

4. The impeller as recited in claim 3, wherein the second rounding has a diameter of at least 1.3 times the thickness of the working vane at its central region.

5. The impeller as recited in claim 1, wherein the thickness of the working vane at its trailing edge region is of the order of 1.1 times the thickness of the working vane at its central region C.

6. The impeller as recited in claim 1, wherein the first rounding at the leading edge region is arranged on the suction face of the at least one working vane (38).

7. The impeller as recited in claim 1, wherein the impeller has at least one rear vane, the at least one rear vane having a trailing edge region, a side edge, a pressure face and a suction face, the trailing edge region of the at least one rear vane having a third rounding.

8. The impeller as recited in claim 7, wherein the third rounding of the at least one rear vane has a circular cross section.

9. The impeller as recited in claim 7, wherein the third rounding of the at least one rear vane has a diameter of at least 1.1 times the thickness of the rear vane.

10. The impeller as recited in claim 9, wherein the third rounding is at least 1.3 times the thickness of the rear vane.

11. An impeller for a centrifugal pump, the impeller comprising a hub with at least one solid and rigid working vane, the at least one solid and rigid working vane having a leading edge region, a trailing edge region, a central region, a thickness at the central region, a side edge, a pressure face, and a suction face, the leading edge region of the at least one solid and rigid working vane being provided with a first rounding having a thickness greater than that in the central region, the trailing edge region of the at least one solid and rigid working vane being provided with a second rounding to have a thickness greater than that in the central region, wherein the side edge of the at least one working vane is rounded.

12. The impeller as recited claim 11, wherein the side edges of the working vanes or rear vanes or the leading and/or trailing edges of the shrouds and disks are rounded such that the radius at the edges is at least one quarter of the thickness of the working vanes, rear vanes or shrouds, respectively.

13. An impeller for a centrifugal pump, the impeller comprising a hub with at least one solid and rigid working vane, the at least one solid and rigid working vane having a leading edge region, a trailing edge region, a central region, a thickness at the central region, a side edge, a pressure face, and a suction face, the leading edge region of the at least one solid and rigid working vane being provided with a rounding having a thickness greater than that in the central region, the trailing edge region of the at least one solid and rigid working vane being provided with a rounding to have a thickness greater than that in the central region, the impeller having at least one rear vane, the at least one rear vane having a trailing edge region, a side edge, a pressure face and a suction face, the trailing edge region of the at least one rear vane being having a third rounding, wherein the side edge of the at least one rear vane is rounded.

14. An impeller for a centrifugal pump, the impeller comprising a hub with at least one solid and rigid working vane, the at least one solid and rigid working vane having a leading edge region, a trailing edge region, a central region, a thickness at the central region, a side edge, a pressure face, and a suction face, the leading edge region of the at least one solid and rigid working vane being provided with a first rounding having a thickness greater than that in the central region, the trailing edge region of the at least one solid and rigid working vane being provided with a second rounding to have a thickness greater than that in the central region, wherein the trailing edge of the shroud is rounded.

* * * * *